United States Patent [19]

Palm et al.

[11] 4,232,048

[45] Nov. 4, 1980

[54] PACKAGE CONTAINING PRESSURED LIQUID

[75] Inventors: Lars-Erik Palm, Höör; Gert Nedstedt, Malmö; Bengt Nilen, Landskrona, all of Sweden

[73] Assignee: AB Ziristor, Lund, Sweden

[21] Appl. No.: 913,944

[22] Filed: Jun. 9, 1978

Related U.S. Application Data

[63] Continuation of Ser. No. 731,994, Oct. 12, 1976, abandoned.

[30] Foreign Application Priority Data

Oct. 28, 1975 [SE] Sweden ..... 7512022

[51] Int. Cl.[3] ..... B65D 85/72; B65D 77/06

[52] U.S. Cl. ..... 426/115; 220/461; 220/462; 229/7 R; 229/55; 426/106; 426/126

[58] Field of Search ..... 426/106, 115, 126, 127; 229/55, 7 R; 220/461, 462, 463

[56] References Cited

U.S. PATENT DOCUMENTS

| | | | |
|---|---|---|---|
| 2,177,918 | 10/1939 | Vogt et al. . | |
| 2,180,841 | 11/1939 | Vogt | 229/14 BE |
| 2,365,159 | 12/1944 | Walton et al. | 229/14 BE |
| 3,078,026 | 2/1963 | Meinecke et al. | 229/14 B |
| 3,143,249 | 8/1964 | Merrill et al. | 229/14 B |
| 3,206,094 | 9/1965 | Humphrey et al. | 229/14 BA |
| 3,469,760 | 9/1969 | Rausing et al. | 229/14 B |
| 3,620,774 | 11/1971 | Ford et al. | 426/106 |
| 3,662,944 | 5/1972 | Joosten | 229/14 B |
| 3,924,008 | 12/1975 | Ford et al. | 426/106 |
| 3,982,029 | 9/1976 | Rausing | 426/106 |
| 4,000,325 | 12/1976 | Rausing | 229/14 BE |

FOREIGN PATENT DOCUMENTS

| | | | |
|---|---|---|---|
| 261232 | 11/1963 | Australia | 229/14 BA |
| 2404126 | 8/1974 | Fed. Rep. of Germany | 229/55 |
| 944565 | 12/1963 | United Kingdom | 229/14 B |
| 1209426 | 10/1970 | United Kingdom | 229/14 B |
| 1302450 | 1/1973 | United Kingdom . | |

*Primary Examiner*—SteveN. L. Weinstein

*Attorney, Agent, or Firm*—Burns, Doane, Swecker & Mathis

[57] ABSTRACT

A package for a pressurized liquid includes an inner container for the liquid having a generally cushion-like shape made from a tubular material which is sealed transversely at its opposite ends. The tubular material is a laminate of thin plastic and metallic foil impervious to the liquid. The inner container is enclosed within an outer reinforcing casing, open at both ends, which extends for the full length of the inner container. The casing is made from a relatively stiff material and consists of paper board the outside of which is coated with a liquid-tight layer.

11 Claims, 5 Drawing Figures

PACKAGE CONTAINING PRESSURED LIQUID

This is a continuation, of application Ser. No. 731,994, filed Oct. 12, 1976, now abandoned.

The present invention relates to a package for a pressurized liquid comprising a liquid-tight, cushion-shaped container or tube and a casing of small extensibility. The container consists substantially of a piece of a flexible tube which is filled with contents and is sealed by means of two transverse seals, and which is so arranged in the casing that the transverse seals extend in longitudinal direction of the casing.

Packing containers for pressurized liquid contents are known and are used inter alia as consumer packages for beer and aerated beverages. Such packing containers have to meet uncommonly high demands of strength and tightness: on the one hand they must withstand the pressure exerted by the contents in the container, and on the other hand they must be gastight, since otherwise oxygen may penetrate into the package and destroy the product. The first condition, that is to give the packing container sufficient mechanical strength, can naturally be solved simply by manufacturing the packing container of a material of a strength which is sufficient for the purpose. However, if at the same time the other condition is also to be observed (i.e., the material should be gastight), it will be found that the choice of materials is greatly limited. When high imperviousness to gases is demanded, only two materials are practical, namely glass and metal, both of which make it possible to produce packages of long durability. With lower demands regarding durability, e.g., it is expected that the product will be consumed relatively quickly, it is also conceivable to use other materials, e.g. plastics, which, however, are less impervious to gas and have shorter durability than glass or metal. This discussion is shown on the market, where glass bottles and metal tins completely dominate at present as disposable packages for beer and aerated drinks.

Glass bottles as well as metal tins thus fully meet the demands in respect of tightness and strength, but they are subject to other disadvantages, e.g. high material consumption, which must be regarded a particularly serious disadvantage in disposable packages. The reason for the high material consumption is that although very thin layers of glass as well as metal provide exceptional imperviousness to gas, the container walls nevertheless must be given an appreciable thickness to meet the demand for strength and the capacity to withstand the internal pressure.

One way to avoid this high material consumption is to manufacture the package of several different materials: i.e., separate the functions of tightness and strength by combining an impermeable inner container with a mechanically durable surrounding packing portion. This principle has been applied in a number of known packing containers, and also constitutes the basis for the packing containers in accordance with the present invention. It is essential in this type of packing container to select for the inner, impermeable container a material which is sufficiently flexible so as to permit a transfer of the forces arising because of the internal pressure to the surrounding, force-absorbing, outer casing of the package. This condition has limited the choice of material for the inner part of the container up to now: all the known packages been made of some type of plastic material. Such packages have therefore a limited durability compared with glass bottles.

A known package of this type comprises a liquid-tight container of relatively thin plastic material which container is long and narrow, "cushion-shaped". The centre portion of the container is surrounded by a substantially cylindrical casing with extremities of the container projecting from both ends of this casing. Owing to the original cushion-shape of the inner container, the corners of the container also extend sideways beyond the axial extension of the casing. On these projecting parts of the container are portions of the seals that formed the container, which are thus not protected by the casing and can easily be damaged during transport and handling. Moreover, the package has an awkward shape and lacks e.g. a plane surface which might serve as a standing base.

It is an object of the present invention to provide a package of the abovementioned type, in which the inner container, and above all the sealing joints of the inner container, are well protected by the surrounding casing.

It is a further object of the present invention to provide a package of the abovementioned type which package has an attractive and practically serviceable shape.

It is a further object of the present invention to provide a package of the abovedescribed type, which is not subject to the disadvantages which the containers of this type known up to now possess.

These objects are achieved in accordance with the present invention, in a package of the type described above in which the casing is at least of length equal to the container, the corner lugs of the container are folded back and are fixed in the casing, and the extremities of the container situated at the casing ends have a substantially convex shape.

Preferred embodiments of the package in accordance with the invention have furthermore been given the characteristics which are evident from the subsidiary claims.

The package comprising an inner container and an outer casing in accordance with the invention will be described in greater detail in the following with reference to the attached schematic drawings.

Figure 1:
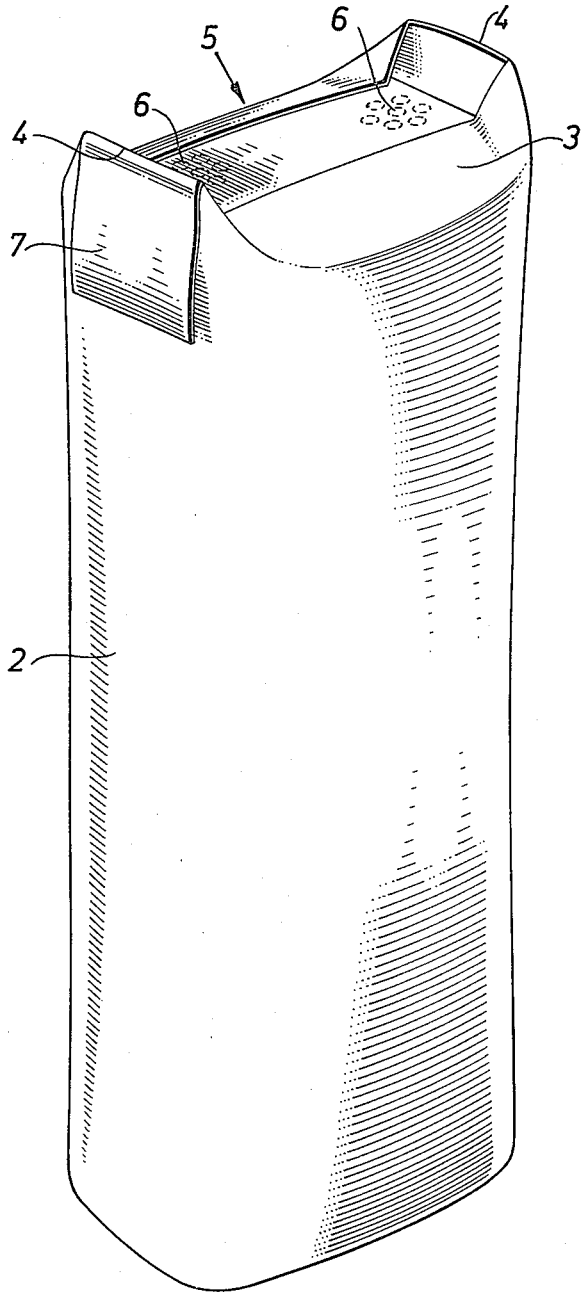
FIG. 1 shows the package in accordance with the invention in perspective representation.

The preferred embodiment of the package in accordance with the invention shown on the drawings comprises an inner, liquid-tight container 1 (FIG. 2 and 3) and an outer casing 2 of relatively rigid material surrounding the container. The casing is tubular and open at both ends. In the upper edge region of the casing 2 (see FIG. 1) are two opposed portions 3 folded inwardly towards one another, and which rest against and are joined to the inner container 1. The two portions 3 form, together with the intermediate, not folded-down, edge portions 4 a rectangular upper opening 5 of the casing. The top part of the container 1 is visible through this upper opening. This top part of the container is provided at both ends of the rectangular casing opening 5 with pouring outlets 6, each of which has the form of a number of small holes which are arranged within two limited areas at the ends of the rectangular opening 5. The two pouring outlets 6, as well as the whole part of the container 1 visible in the rectangular opening 5, are covered by a tear-off cover strip 7. One end of the tear-off strip extends over one edge portion 4 of the casing and rests against the outer surface of the casing 2.

Figure 2:
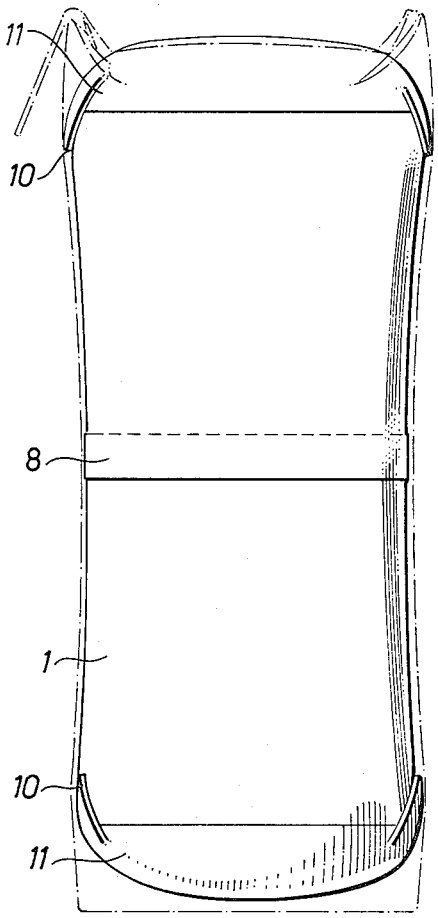
FIGS. 2 and 3 are side views of the inner container and show the same as it is shaped when it has been inserted in the casing, which is indicated by means of dash-and-dot lines.
Figure 3:
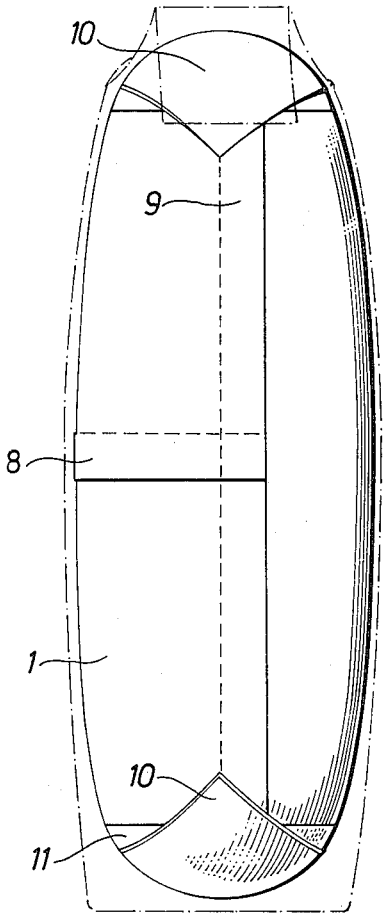

The inner container is shown in FIG. 2 and 3. The inner container is made from a flexible tube having a diameter which substantially corresponds to the height of the inner container shown. The flexible tube is filled with the contents and is divided by repeated transverse seals arranged in pairs at each sealing zone into a number of separate containers 1. The containers are then severed from one another by cutting between the two parallel transverse seals provided in each sealing zone. The original flexible tube is made by conversion of a plane web and is, therefore, provided with a longitudinal or first joint which is located substantially in the center on the container 1 as indicated by reference numeral 8, and extends transversely of the container itself. The transverse seals or second seals dividing the flexible tube extend vertically along the two sides of the inner container and are indicated by reference numeral 9 (only one being visible in FIG. 3). The container produced by the transverse seals 9 is given a cushion-shaped appearance and is converted to the shape shown in FIG. 2 and 3 by folding the four corner-lugs 10 to rest against the transverse seals 9. The two extremities of the inner container 1, which are not protected by the surrounding casing 2, are reinforced by means of the layer of reinforcement material 11 which may be the same material as the container.

The inner container 1 is made of a flexible material and can therefore be pressed by the pressure of the contents closely against the casing 2. A preferred material for the inner container comprises layers of plastics and metal foil, the metal foil improving the imperviousness to gas of the plastic material, and also making the resulting package opaque to light. In particular, the inner container is manufactured from a laminated material which comprises an inside layer of polyethylene, an outside layer of polyester, and an aluminum foil of small thickness (50–20 $\mu$) situated between these layers.

Figure 4:
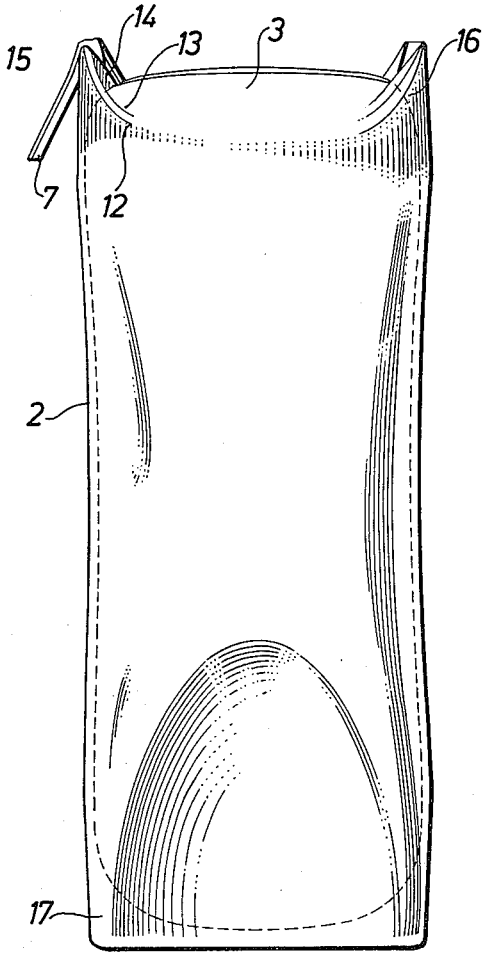
FIGS. 4 and 5 are side views of packages in accordance with the invention, the contour of the inner container being indicated by means of broken lines.
Figure 5:
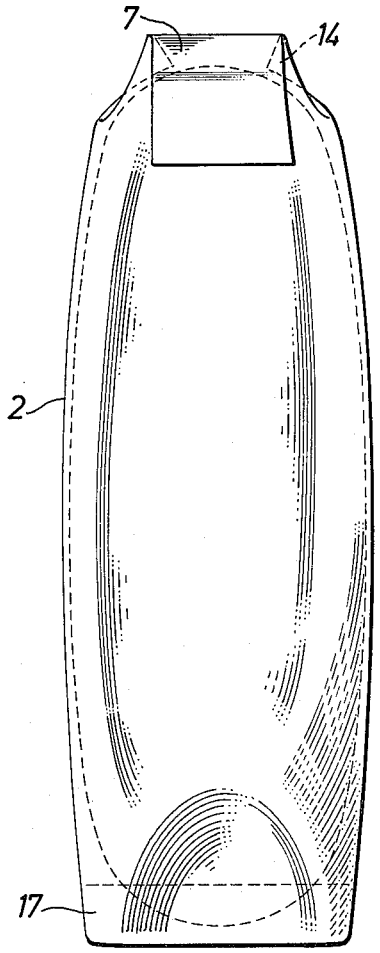

The outer part of the package or the casing 2 has a number of functions and serves inter alia for the primary absorption of radial pressure generated by the contents located in the inner container 1. The surfaces of the casing and of the container which contact one another are joined together by means of glue whereby forces arising in an axial direction of the container are transferred to and absorbed by the casing, since the casing cannot extent itself. The layers of reinforcement material 11 arranged at the ends of the container, as well as the folded down corner lugs 10 are joined to the casing, which further increases the capacity of the container to withstand stresses. The casing 2 also gives the package stability and determines its outward shape. The shaping by the casing 2 is illustrated most cleary by FIGS. 4 and 5, which show the finished and filled package. The flexible inner container is pressed by the contents against the inside of the casing 2 as indicated by dash-and-dot lines. As shown by the figures, the casing is not completely cylindrical but has, if viewed from the one side, a somewhat inwardly-curved middle portion (FIG. 4), while when turned a quarter turn it shows instead an outwardly-bulging middle-portion (FIG. 5). This special shaping of the casing 2 is of course closely allied to the form of the inner container 1, since, as mentioned earlier, it is essential that the sidewalls of the container 1 are in close contact with the inner wall of the casing 2.

The upper end of the casing 2 has also been given a special shape which partly serves to protect the upper convex end of the inner container 1, and partly provides a package top which has appropriate pouring properties, openability and appearance. This has been achieved by folding the two longitudinal opposed portions 3 towards one another the portions 3 are divided from the remaining part of the casing 2 by means of crease-lines 12, 13. The crease-lines 12, 13 run substantially parallel (in fact somewhat curved) with the upper edge of the casing and at a little distance below the same and have for the greater part of their length a common extension. At their two extremities the two crease-lines divide and run curving upwards in the direction of the upper edge of the casing which they meet at a little distance from one another. In this way the long and narrow, curved area 14 is produced, which is limited by the crease-lines 12, 13 and the part of the upper edge of the casing situated between them. The two long and narrow portions 3 take up jointly about ⅔rds of the circumference of the upper end of the casing; the remaining third is taken up by two edge areas 15, 16 which are located between the two portions 3 and are connected with the remainder of the casing 2. The special shaping of the portions 3 and the crease-lines 12, 13 produces the result that the portions 3, after being folded down to rest against the upper convex end of the container 1, and retained automatically in a self-locking manner in this position, since, if they are raised up again to their original position, they force (via the portions 14) the edge areas 15 and 16 of the casing 2 to withdraw from one another, which is movement counteracted by the elasticity inherent in the casing.

The casing is made appropriately of paper which is covered on the outside by a liquid-tight layer so as to prevent the absorption of moisture and to provide a suitable, attractive surface to which decoration can be applied. To prevent any absorption of moisture at the bottom end of the casing, the annular bottom edge 17 serving as a standing base is doubled up, so that the liquid-tight layer applied to the outside of the casing extends some way upwards along the inside of the casing which in FIG. 4 and 5. It is also possible to allow the liquid-tight layer to extend only around the lower edge of the casing. A corresponding liquid-tight layer may be arranged in corresponding manner at the upper end of the casing. Finally it has to be stated that the material layer 11 reinforcing the container may also be integral with the container material, i.e., it may consist of thicker portions of the material and be formed at the same time as the web of container material is manufactured.

The proposed material for the inner container, as mentioned earlier, is a laminate comprising a layer, acceptable to the contents, of low density polyethylene (LDPE, 50 g/m$^2$), an outer layer of polyester (35 g/m$^2$) and an intermediary layer of aluminum foil (20 g/m$^2$). The mutual attachment of the layers is such that the aluminum foil has at all points a very strong adherence to the plastic layers. This means that when the material is subjected to forces which cause the plastic layer to expand, the forces of expansion will be distributed uniformly over the surface of the aluminum foil, so that not marked cracks or breakages occur, but that instead the aluminum foil is thinned out evenly over the whole surface. Naturally, the thinning out consists in effect of a large number of extremely small crack formations or thinnings out which, however, are of such modest size that they have no negative influence upon the imperviousness to gas or the opaqueness of the laminate.

We claim:

1. A package for pressurized fluid contents comprising a liquid-tight, elongated, cushion-shaped, flexible inner container containing said fluid contents and a substantially non-extensible elongate outer tubular casing therefor, said cushion-shaped container having a pair of opposed vertical seals along the length of the container and corner lugs folded back against the pair of opposed seals, the upper and lower ends of the elongated container having a convex shape, said casing having a length at least equal to that of said container and a top edge portion with two opposed circumferential portions folded inwardly toward each other against at least a portion of the convex upper end of said container and opposed intermediate circumferential portions of the top edge portion of said casing positioned between the opposed inwardly folded portions, the intermediate circumferential portions remaining unfolded and extending upwardly as extensions of the wall of the casing to resist unfolding of said inwardly folded portions, the container being in contact with an inner surface of said casing along said seals to reinforce the latter, the folded corner lugs of the container being fixed to the inner wall of said casing, the two inwardly folded opposed portions of said casing being fixed to the convex end of said container, the inner edges of the two opposed inwardly folded circumferential portions at the top of the casing being spaced apart to provide a substantially rectangular opening in said casing to expose a portion of the convex end portion of the container, the exposed portion being provided with at least one pouring opening therein and further including releasable means for covering the pouring opening.

2. A package as claimed in claim 1 wherein said casing is provided with crease lines for the two opposed inwardly folded circumferential portions at the top edge of said casing.

3. A package as claimed in claim 1 wherein the at least one pouring opening is disposed at one end of the rectangular opening in said casing and wherein one of the opposed intermediate portions at the top of said casing serves as a pouring edge when the contents are poured from the package.

4. A package as claimed in claim 1 and further comprising a layer of a reinforcing material disposed over the convex ends of said container.

5. A package as claimed in claim 1 wherein the pouring opening comprises a plurality of small holes disposed within a limited area.

6. A package as claimed in claim 1 wherein said container is formed of a laminate having at least two layers of plastic material and a layer of metal foil therebetween.

7. A package as claimed in claim 6 wherein the layers of plastic material are formed of polyester and polyethylene respectively and the layer of metal foil comprises aluminum foil.

8. A package as claimed in claim 7 wherein the layer of aluminum foil has a thickness of 5–20 $\mu$.

9. A package as claimed in claim 1 wherein said casing comprises a layer of fibrous material having a liquid-tight layer on the outside thereof.

10. A package as claimed in claim 9 wherein said casing, at its lower end, is folded upwardly.

11. A package as claimed in claim 10 wherein the lower end of said casing is folded upwardly and inwardly.

* * * * *